US008535002B2

(12) United States Patent
Jairazbhoy et al.

(10) Patent No.: US 8,535,002 B2
(45) Date of Patent: Sep. 17, 2013

(54) HVAC DIFFUSER WITH MOUNTING RECEPTACLE FOR VARIABLE BLOWER CONTROL

(75) Inventors: Vivek A. Jairazbhoy, Farmington Hills, MI (US); LeeAnn Wang, Canton, MI (US); Mehran Shahabi, Ypsilanti, MI (US)

(73) Assignee: Automotive Components Holdings LLC, Dearborn, MI (US)

( * ) Notice: Subject to any disclaimer, the term of this patent is extended or adjusted under 35 U.S.C. 154(b) by 532 days.

(21) Appl. No.: 12/852,965

(22) Filed: Aug. 9, 2010

(65) Prior Publication Data

US 2012/0034077 A1 Feb. 9, 2012

(51) Int. Cl.
*F04D 29/44* (2006.01)

(52) U.S. Cl.
USPC ..... 415/211.2

(58) Field of Classification Search
USPC ..... 415/211.2
See application file for complete search history.

(56) References Cited

U.S. PATENT DOCUMENTS

| | | | | |
|---|---|---|---|---|
| 5,531,484 | A | 7/1996 | Kawano | |
| 6,146,092 | A | 11/2000 | Botros et al. | |
| 6,773,340 | B2 | 8/2004 | Nakagawa et al. | |
| 7,048,035 | B2 | 5/2006 | Farag | |
| 2001/0017203 | A1 * | 8/2001 | Uemura et al. | 165/201 |
| 2010/0074743 | A1 | 3/2010 | Jairazbhoy et al. | |
| 2010/0154468 | A1 * | 6/2010 | Shaska et al. | 62/498 |

FOREIGN PATENT DOCUMENTS

JP 2000145700 A * 5/2000

* cited by examiner

*Primary Examiner* — Nathaniel Wiehe
*Assistant Examiner* — Alonzo N Coleman
(74) *Attorney, Agent, or Firm* — MacMillan, Sobanski & Todd, LLC

(57) ABSTRACT

An automotive HVAC diffuser connects to a blower and a variable blower control (VBC) module having a plurality of cooling fins. An inlet receives air flow from the blower. An outlet is downstream from the inlet. An enclosed passageway is provided between the inlet and the outlet for forming a diffused air stream at the outlet. The enclosed passageway has a plurality of peripheral walls for guiding the air stream between the inlet and the outlet, including a curved outer peripheral wall corresponding to a region with a tendency for a high flow as a result of centrifugal effects. One of the peripheral walls includes a VBC receptacle formed as a depression into the peripheral wall having a substantially flat mounting surface and a first sloped side at an upstream end of the VBC receptacle to shape a portion of the diffused air stream. The flat mounting surface includes a plurality of cooling fin receiving slots arranged to receive the cooling fins, whereby the cooling fins extend into an interior of the diffused air stream.

6 Claims, 7 Drawing Sheets

HVAC DIFFUSER WITH MOUNTING RECEPTACLE FOR VARIABLE BLOWER CONTROL

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to an automotive heating, ventilation, air conditioning (HVAC) system having an electrically controlled blower motor, and, more specifically, to structures for obtaining even diffusion of air simultaneously with improving cooling of the blower controller.

In a typical automotive HVAC system, a blower delivers fresh or recirculated air to heat exchangers (e.g., an evaporator) which is then distributed to the passenger cabin via ducts. A diffuser couples the air stream from the blower to the evaporator. Due to space requirements, the diffuser turns the air stream for delivery to the evaporator. The blower/diffuser combination produces a high speed, non-uniform flow that tends to produce high flows on the outer periphery of the diffuser due to centrifugal forces.

A uniform velocity distribution at the diffuser outlet and in the evaporator is very desirable to ensure efficient evaporator performance, higher air flow, and reduced noise generation as the air passes through the evaporator core. Various vanes and wall guides have been added to the diffuser to improve the uniformity of the air flow. One example is U.S. patent application publication 2010/0074743A1 of Jairazbhoy et al, entitled "Air Diffuser for a HVAC System," which is hereby incorporated by reference in its entirety.

The diffuser is normally made as a molded plastic part. It has not been possible to make interior vanes of sufficient height extending from a corresponding wall due to limitations in the molding process and limitations associated with handling of the part after molding (e.g., breakage of the vanes). Therefore, vanes can affect the air flow near to the diffuser walls but are less able to affect air flow at the center of the diffuser. Furthermore, the die draw of the molding process does not allow vanes to extend from walls that are perpendicular to one another (i.e., vanes cannot extend from both the curved outer peripheral wall and either of the transverse (i.e., floor and ceiling) walls in the same molded section).

For similar reasons, wall guides have a greater influence on air flow in the regions of the walls. Known vanes and wall guides may be insufficient to obtain a desired uniformity of a diffused air stream when it becomes necessary to manipulate flow at the core, central portion of the diffuser.

The typical automotive HVAC system allows a user to select a rotating speed of the blower via a switch or dial. A variable blower control (VBC) module is an electronic controller that is mounted to the outside of the diffuser between the blower and the evaporator. Cooling fins penetrate the diffuser wall so that they benefit from the air flow within the diffuser. The VBC module has been conventionally mounted on a relatively flat exterior surface of the diffuser wall.

SUMMARY OF THE INVENTION

In one aspect of the invention, a diffuser is provided for an automotive heating, ventilation, air conditioning (HVAC) system, wherein the HVAC system includes a blower and a variable blower control (VBC) module having a plurality of cooling fins. An inlet receives air flow from the blower. An outlet is downstream from the inlet. An enclosed passageway is provided between the inlet and the outlet for forming a diffused air stream at the outlet. The enclosed passageway has a plurality of peripheral walls for guiding the air stream between the inlet and the outlet, including a curved outer peripheral wall corresponding to a region with a tendency for a high flow as a result of centrifugal effects. One of the peripheral walls includes a VBC receptacle formed as a depression into the peripheral wall having a substantially flat mounting surface and a first sloped side at an upstream end of the VBC receptacle to shape a portion of the diffused air stream. The flat mounting surface includes a plurality of cooling fin receiving slots arranged to receive the cooling fins, whereby the cooling fins extend into an interior of the diffused air stream.

DETAILED DESCRIPTION OF PREFERRED EMBODIMENTS

Cooling fins of conventionally mounted VBC modules did not function as effective vanes because of incorrect placement and/or insufficient penetration into the air stream. Cooling fin materials (e.g., aluminum) would be too expensive to merely increase their heights beyond what is required for cooling purposes.

The present invention employs a recessed receptacle in the diffuser wall for mounting the VBC heat sink cooling fins. The receptacle itself protrudes into the diffuser. The cooling fins extend into the central portion of the diffuser to act as a set of vanes, influencing the flow in the core of the diffuser and resulting in improved evaporator coverage, velocity distribution, pressure drop, air flow, & aerodynamic noise.

The receptacle can also be placed in the outer peripheral wall of the diffuser with the cooling fins substantially horizontal, permitting guidance of the flow upwards or downwards as desired, a capability not present in prior art vertical vanes or wall guides. An outer cooling fin of the VBC heat sink can also be used as a vane in conjunction with a wall, a wall guide, or a molded guide vane to accelerate or decelerate flow as it passes through the gap. This is accomplished by a changing the cross section between the fin and the corresponding wall, wall guide, or vane along the length of the fin (i.e., using the Bernoulli Effect).

Figure 1:
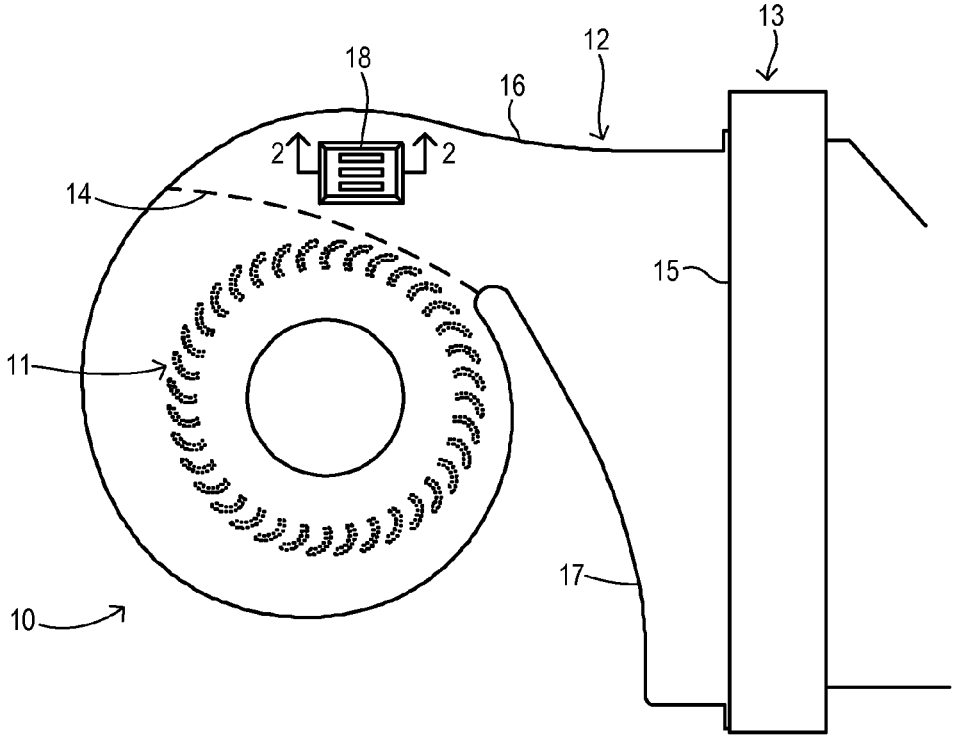
FIG. 1 is a top view showing a blower, diffuser and evaporator of an automotive HVAC system.

Referring to the top view of FIG. 1, a portion of an automotive HVAC system 10 has an air flow path or stream from a blower 11 with a motor-controlled bladed wheel through a diffuser 12 to an evaporator 13. Diffuser 12 has an inlet generally indicated at 14 and an outlet 15. Diffuser 12 creates an enclosed passageway between inlet 14 and outlet 15 which is enclosed by a plurality of peripheral walls that guide the air stream. The walls include a curved outer peripheral wall 16 and an inner peripheral wall 17. "Outer" and "inner" are relative to the curved path of the air stream through diffuser 12. Because of the curve, curved outer peripheral wall corresponds to a region with a tendency for a high flow as a result of centrifugal effects. Correspondingly, the region adjacent inner wall 17 tends to have a lower flow and a lower pressure. Walls 16 and 17 are vertical in the top view of FIG. 1, and are sometimes referred to as side walls. Upper and lower transverse walls that extend between walls 16 and 17 are sometimes referred to as the ceiling and floor, respectively.

Figure 2:
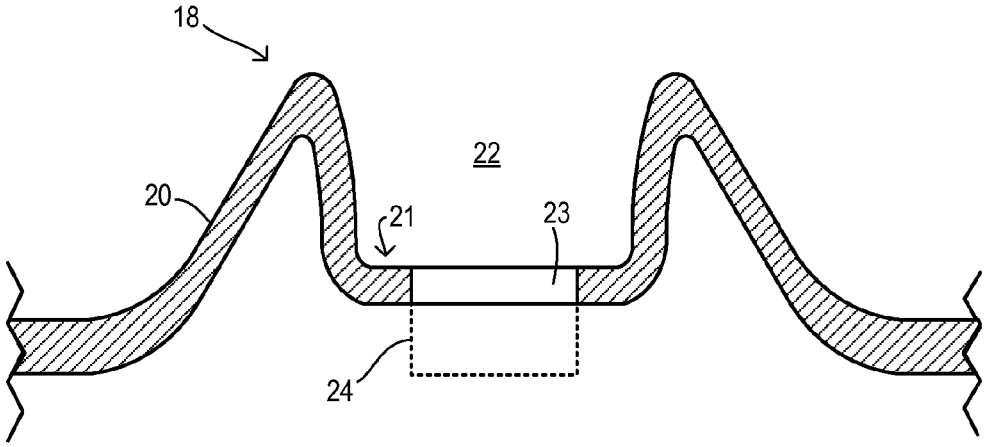
Fig. 2 (Prior Art)
FIG. 2 is a cross section showing a conventional mounting of a VBC module to a diffuser.

FIG. 2 represents one placement of a prior art VBC module. A receptacle 18 includes raised sides 20 around a flat mounting surface 21 to create a space 22 for receiving the VBC module. Raised sides 20 function to create a protected location for the VBC module which is inserted into space 22 so that its cooling fins pass through slots 23. A dashed line 24 shows the region where the cooling fins of the VBC module heat sink enter the air stream within the diffuser. In prior art devices, the cooling fins have not affected the central regions of the air stream.

Figure 3:
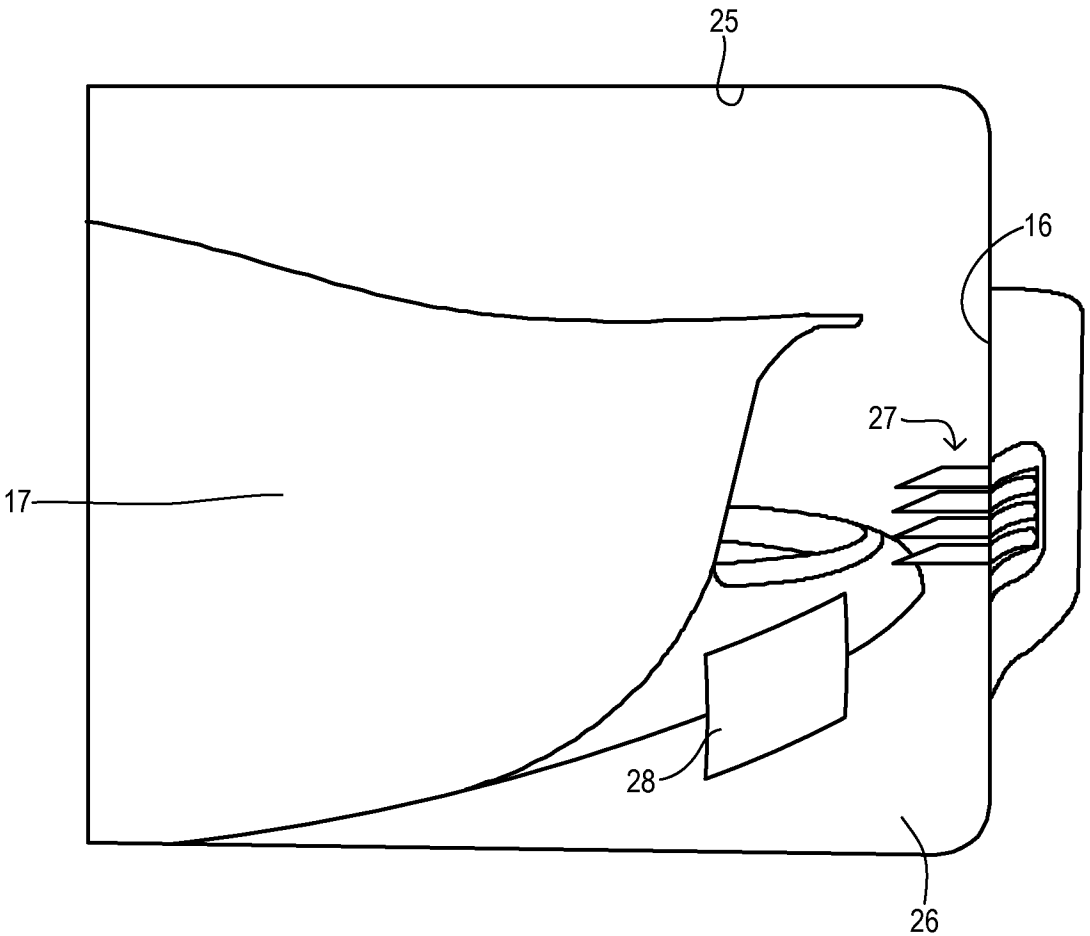
FIG. 3 perspective view showing the interior of a diffuser with guide vanes secured to the inner surface of the diffuser.

FIG. 3 shows prior art vanes for shaping an air stream in a manner that helps achieve a well diffused air stream at the diffuser exit. Outer peripheral wall 16 and inner peripheral wall 17 are joined by a transverse wall 25 and a transverse wall 26 to provide the enclosed passageway of the diffuser. A set of vanes 27 extends from outer peripheral wall 16 and a vane 28 extends from transverse wall 26. In a plastic injection-molded unit formed from two half-shells joined together (as is the typical construction), it is not possible to form vanes that extend in right angles after final assembly since the draw directions must be parallel. In order to provide vanes 27 and 28, one of them must comprise a separate component. Thus, vanes 27 are a separate molded part that is assembled into a receiving hole in wall 16. Vanes 27 may be capable of being formed with a greater height than vanes that are integrally molded with the diffuser, however, manufacturing and assembly costs associated with a separate subcomponent are undesirable.

Figure 4:
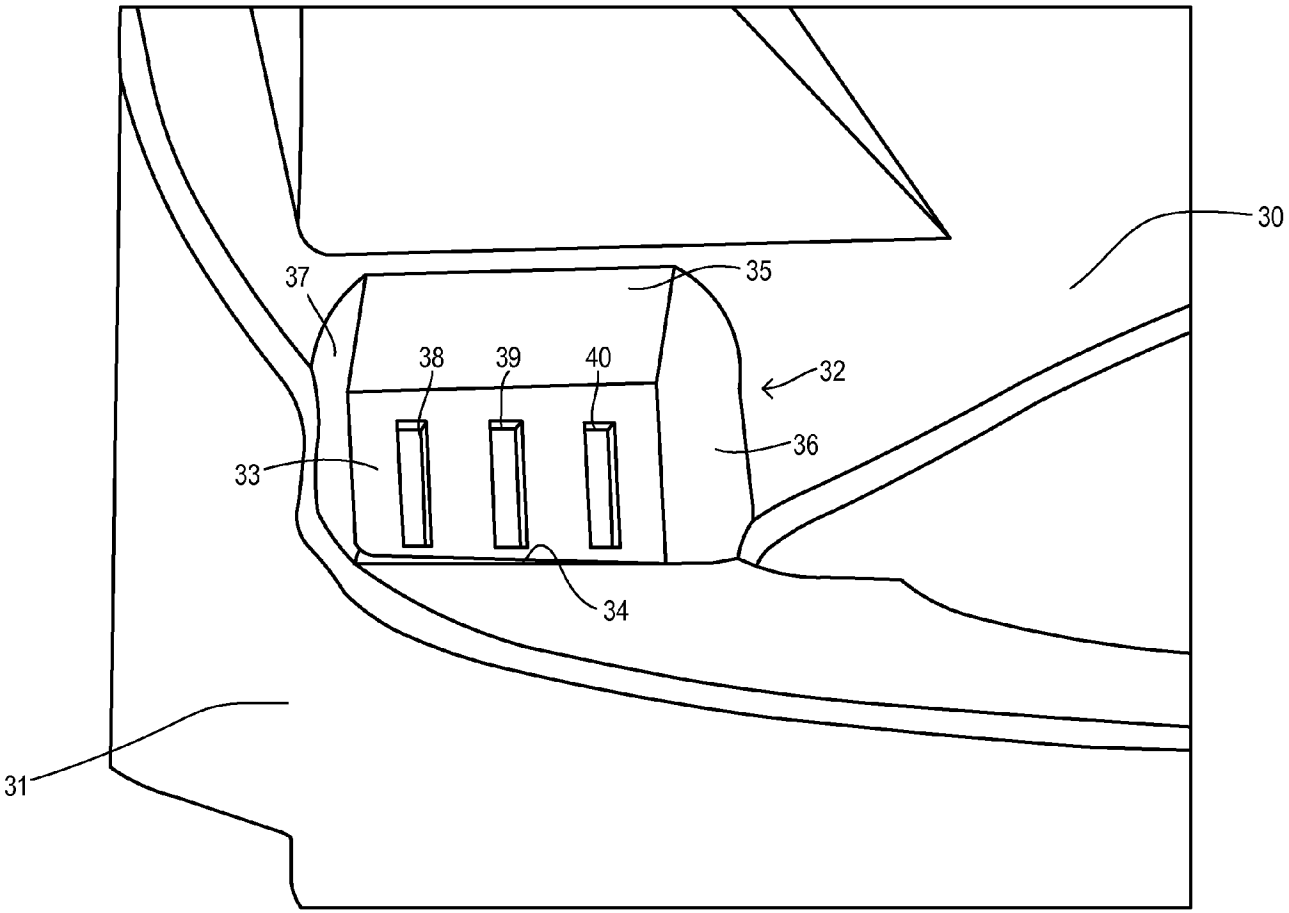
FIG. 4 is an outside, perspective view of the VBC receptacle of the present invention.

FIG. 4 shows a first embodiment of the present invention for mounting a VBC module in a manner that achieves improved manipulation of the air stream. A diffuser includes an upper transverse wall 30 and a curved outer peripheral wall 31. A VBC receptacle 32 is formed as a depression into transverse wall 30 and has a substantially flat mounting surface 33. Receptacle 32 has a first sloped side 34 at the upstream end of receptacle 32, a downstream side 35, and lateral sides 36 and 37. Flat surface 33 has a plurality of cooling fin receiving slots 38-40 that are arranged to receive the cooling fins of the VBC module. By virtue of receptacle 32 being made as a depression into the diffuser, the cooling fins extend into an interior region of the air stream.

Figure 5:
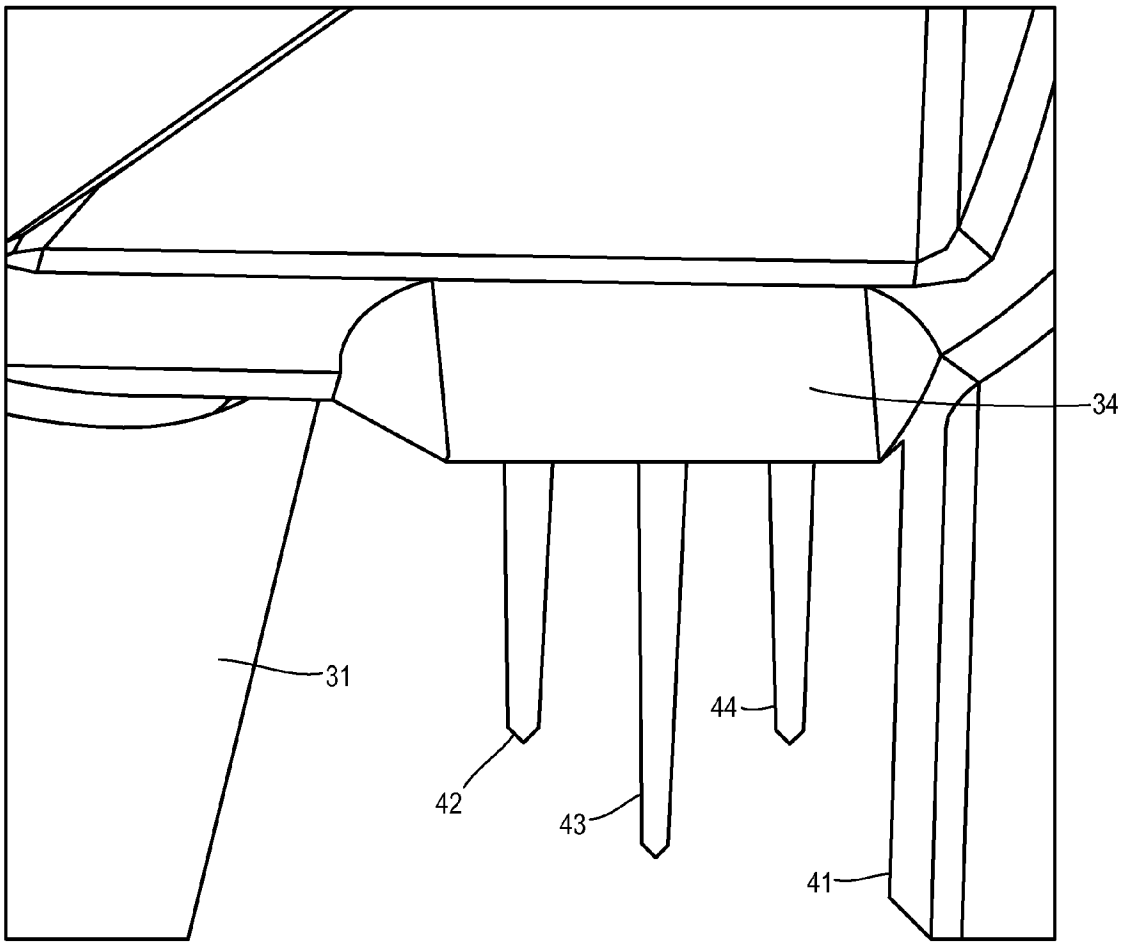
FIG. 5 is an inside, plan view of cooling fins projecting into the diffuser air stream from the VBC receptacle.

Two different aspects of the receptacle of the present invention can be used to separately manipulate the air stream. As shown in FIG. 5, cooling fins 42-44 extend into the core of the air stream between outer wall 31 and an inner peripheral wall 41. Cooling fins 42-44 function as vanes for directing flow as desired. For example, the alignment of the longitudinal sides of cooling fins 42-44 with respect to the impinging air flow can be selected so that a portion of the air flow can be redirected.

In a second mechanism, sloped side 34 redirects airflow away from the upper transverse wall in order to shape a portion of the diffused air stream. Sloped side 34 may be generally parallel with the flow direction of the air stream or may be rotated in a manner to redirect the air flowing over sloped surface 34 toward the inner peripheral wall.

Figure 6:
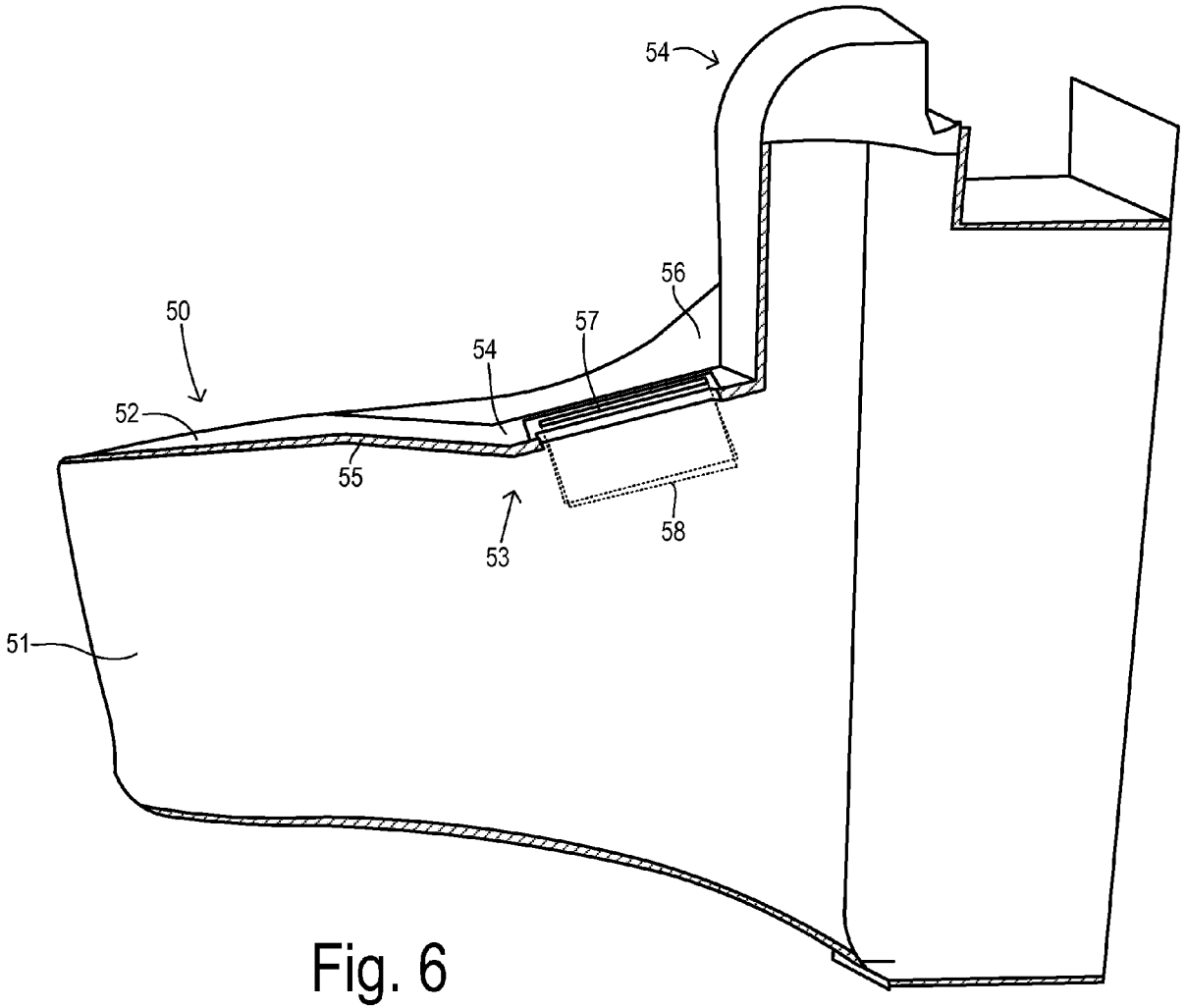
FIG. 6 is a side cross section through another embodiment of the VBC receptacle.

FIG. 6 shows another embodiment for the receptacle. A diffuser 50 has a curved outer peripheral wall 51 and an upper transverse wall 52 into which a VBC receptacle 53 is sunk. A generally flat mounting surface 54 is coupled to a first sloped side 55. A sidewall 56 of receptacle 53 provides part of the enclosure for the VBC module. A plurality of slots 57 are provided in flat mounting surface for receiving the cooling fins of the VBC module so that they extend into the position shown at 58. A mounting structure 59 is provided for coupling diffuser 50 to an evaporator.

Figure 7:
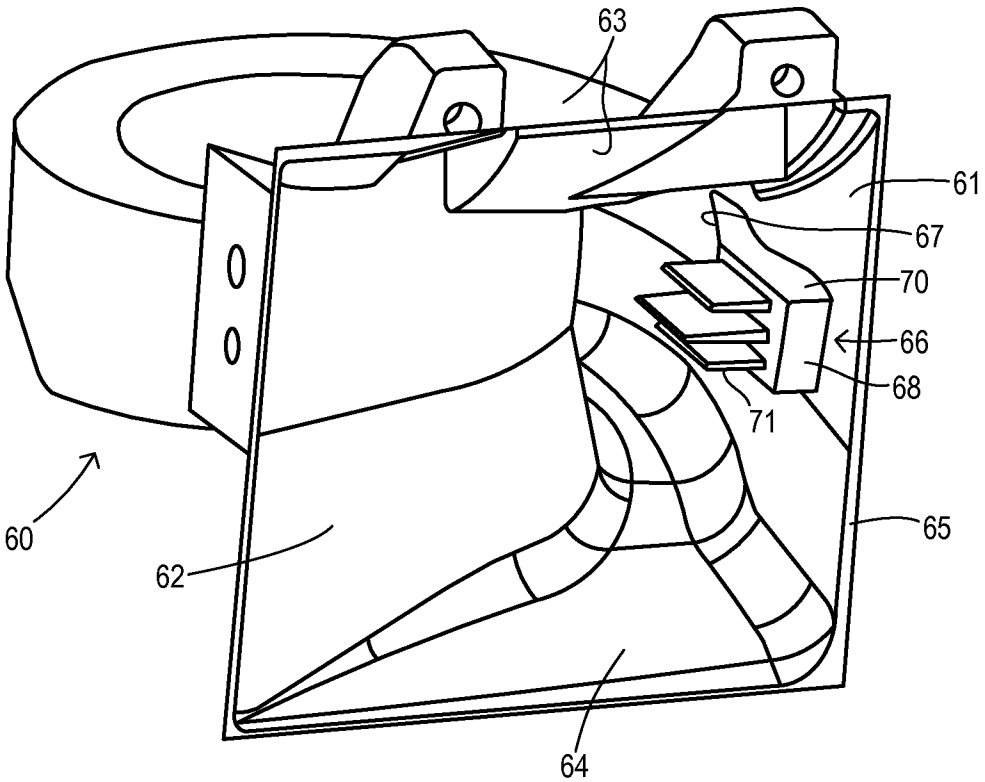
FIG. 7 is an end view of another embodiment of a diffuser with a VBC receptacle in the outer peripheral wall.

FIG. 7 shows an embodiment wherein the VBC receptacle is provided on the outer peripheral wall. Thus, a diffuser 60 has an outer peripheral wall 61 and an inner peripheral wall 62 joined by upper transverse wall 63 and lower transverse wall 64. A diffuser exit 65 is adapted to be coupled to an evaporator housing.

VBC receptacle 66 is formed as a depression into outer peripheral wall 61. An upstream side 67 is sloped in order to shape a portion of the diffused air stream, in particular by directing airflow away from outer peripheral wall 61 which is a region with a tendency for a high flow. Thus, a portion of the diffused air stream is shaped so that flow is increased in (i.e., redirected to) regions with a tendency for a lower flow. Downstream side 68 and lateral sides 70 and 71 of receptacle 66 have relatively little effect on the airflow. Cooling fins 72 extend deep into the air stream for optimal cooling and can optionally be shaped to further redirect a corresponding portion of the diffused air stream at the exit 65.

Figure 8:
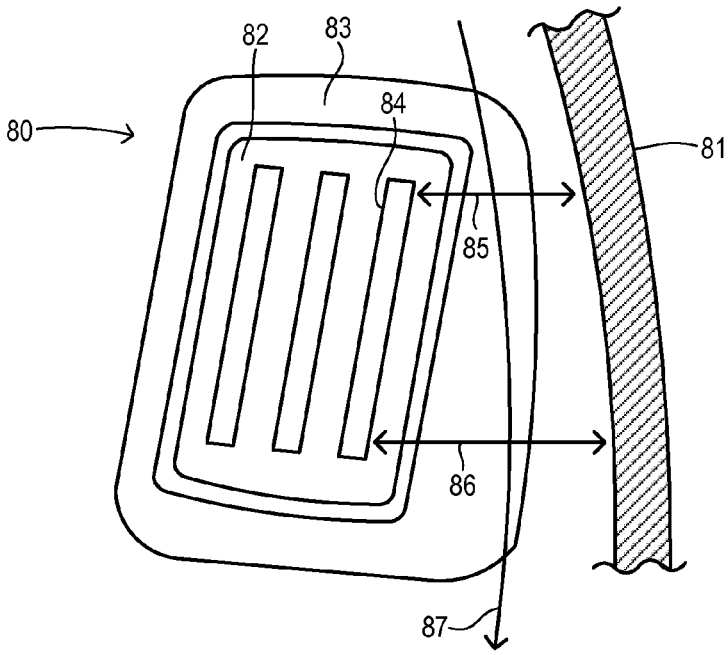
FIG. 8 is a plan view showing an alternative orientation of the cooling fins with respect to a diffuser wall.

FIG. 8 illustrates an additional technique for using the VBC receptacle and cooling fins for shaping the diffused air stream. Receptacle 80 is disposed in close proximity to a wall 81, which may be either an outer wall, inner wall, or transverse wall. Receptacle 80 has a flat mounting surface 82 and a sloped upstream side 83. Cooling fin receiving slots 84 are oriented so that when the cooling fins are inserted they shape a respective portion of the diffused air stream by functioning as guide vanes within the air stream. In particular, at least one cooling fin receiving slot 84 may be oriented so that the cooling fin is slanted with respect to wall 81. Specifically, one end of slot 84 is at a distance 85 from wall 81 while the other end of slot 84 is at a distance 86 from wall 81. Thus, an air path 87 between the cooling fin and wall 81 has a variable cross-section from its beginning to end. The changing cross-section modifies the velocity of the portion of the air stream passing between the cooling fin and wall 81. An increasing cross-section reduces the velocity while a decreasing cross-section increases the velocity. The modified velocity is selected in a manner that improves the even diffusion of the diffused air stream at the outlet.

Figure 9:
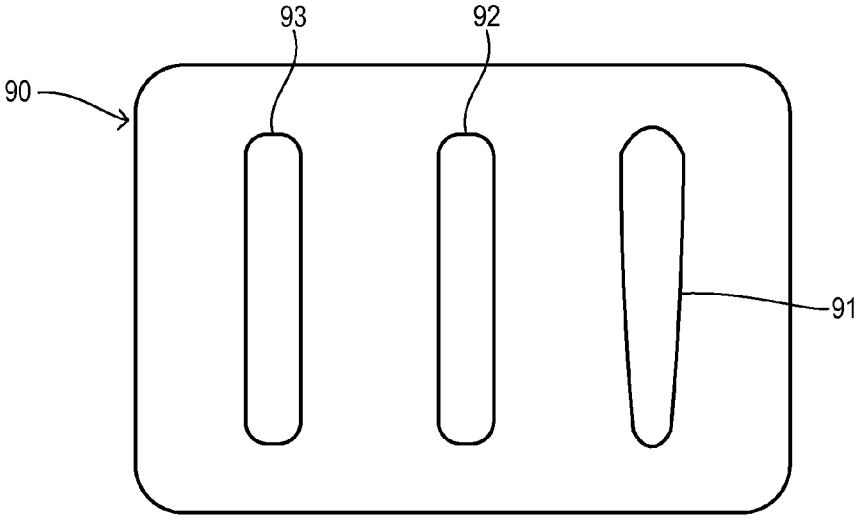
FIG. 9 is a plan view showing an alternative aerodynamic profile of a cooling fin.

FIG. 9 shows another embodiment of a flat mounting surface 90 having cooling fin receiving slots 91-93. Velocity of a portion of the air stream can be modified by using a cooling fin having an aerodynamic profile. Slot 91 may be shaped in correspondence to the aerodynamic profile of the cooling fin. The aerodynamic profile may have the cross-sectional shape of an airplane wing, for example. The slot and the cooling fin do not necessarily have the same profile. Likewise, the cross-section profile of the cooling fin could change along its height.

What is claimed is:

1. A diffuser for an automotive heating, ventilation, air conditioning (HVAC) system, wherein the HVAC system includes a blower and a variable blower control (VBC) module having a plurality of cooling fins, the diffuser comprising:

an inlet for receiving air flow from the blower;

an outlet downstream from the inlet; and an enclosed passageway between the inlet and the outlet for forming a diffused air stream at the outlet, wherein the enclosed passageway has a plurality of peripheral walls for guiding the air stream between the inlet and the outlet, and wherein the peripheral walls include a curved outer peripheral wall corresponding to a region with a tendency for a high flow as a result of centrifugal effects;

wherein one of the peripheral walls includes a VBC receptacle formed as a depression that is sunk into the peripheral wall having a substantially flat mounting surface and a first sloped side at an upstream end of the VBC receptacle to shape a portion of the diffused air stream, wherein the depression is configured to enclose the VBC module, and wherein the flat mounting surface includes a plurality of cooling fin receiving slots arranged to receive the cooling fins, whereby the depression increases a distance by which the cooling fins extend into an interior of the diffused air stream.

2. The diffuser of claim 1 wherein the VBC receptacle is formed in the curved outer wall so that the first sloped side shapes a portion of the diffused air stream by directing air flow away from the region having a tendency for a high flow.

3. The diffuser of claim 1 wherein the VBC receptacle is formed in a transverse wall so that the first sloped side shapes a portion of the diffused air stream by directing air flow away from the transverse wall.

4. The diffuser of claim 3 wherein the cooling fin receiving slots are oriented so that the cooling fins shape a respective portion of the diffused air stream by functioning as guide vanes within the air stream.

5. The diffuser of claim 4 wherein the cooling fin receiving slots are oriented so that at least one cooling fin is slanted with respect to the curved outer peripheral wall in order to modify the velocity of a portion of the air stream passing between the at least one cooling fin and the curved outer peripheral wall.

6. The diffuser of claim 1 further comprising at least one cooling fin, wherein the at least one cooling fin has an aerodynamic profile in order to modify the velocity of a portion of the air stream passing over the at least one cooling fin.

* * * * *